United States Patent [19]

Yamamoto et al.

[11] Patent Number: 4,489,708

[45] Date of Patent: Dec. 25, 1984

[54] HEATING APPARATUS FOR HEATING LIQUID IN A TANK

[75] Inventors: Hideo Yamamoto, Ashiya; Seiichi Katsube, Nishinomiya, both of Japan

[73] Assignee: Kyodo Kisen Kaisha, Ltd, Kobe, Japan

[21] Appl. No.: 484,601

[22] Filed: Apr. 13, 1983

[30] Foreign Application Priority Data

| | | | |
|---|---|---|---|
| Apr. 14, 1982 | [JP] | Japan | 57-62793 |
| Jan. 22, 1983 | [JP] | Japan | 58-8931 |
| Jan. 28, 1983 | [JP] | Japan | 58-13208 |
| Feb. 7, 1983 | [JP] | Japan | 58-20514 |

[51] Int. Cl.[3] ..... F24H 1/00

[52] U.S. Cl. ..... 126/362; 126/366; 126/378; 126/19.5; 122/235 R; 122/408 R; 123/557; 237/12.3 B; 237/28

[58] Field of Search ..... 126/19.5, 362, 378, 126/366; 165/143, 145; 219/325, 326, 381; 122/18, 235 T, 235 R, 305, 406 R, 408 R; 60/320; 237/12.3 B, 28, 59, 61; 123/557, 546

[56] References Cited

U.S. PATENT DOCUMENTS

| | | | |
|---|---|---|---|
| 2,432,362 | 12/1947 | Worn et al. | 165/143 X |
| 2,916,030 | 12/1959 | Hoeth | 126/366 X |
| 2,980,172 | 4/1961 | Thompson | 126/378 X |
| 3,399,718 | 9/1968 | Phillips, Jr. | 126/366 X |
| 3,688,839 | 9/1972 | Kirschner | 126/362 X |
| 3,766,974 | 10/1973 | Kirschner | 126/362 X |
| 4,414,464 | 11/1983 | Cloutier et al. | 126/362 X |

FOREIGN PATENT DOCUMENTS

| | | | |
|---|---|---|---|
| 271567 | 5/1927 | United Kingdom | 126/366 |

*Primary Examiner*—Randall L. Green

*Attorney, Agent, or Firm*—Cushman, Darby & Cushman

[57] ABSTRACT

A heating apparatus for heating liquid stored in a tank (1) comprises a heater (4) housed in a hollow member (3) and extending substantially over an entire length of the hollow member (3). The hollow member (3) includes inlet openings (3*a*) at respective longitudinal ends to take in the liquid from the tank interior, and an outlet opening (3*b*) at a longitudinally intermediate position to permit exit of the liquid heated by the heater (4).

5 Claims, 17 Drawing Figures

HEATING APPARATUS FOR HEATING LIQUID IN A TANK

BACKGROUND OF THE INVENTION

1. Field of the Invention

This invention relates to a heating apparatus for locally heating fuel oil in a fuel storage tank installed on the ground to reduce viscosity of the fuel oil so that the fuel oil may be drawn out of the tank with small power, or in a fuel storage tank installed, for example, on a ship to heat the outgoing fuel oil to a temperature suited to combustion as well as to enable the fuel oil to be drawn out of the tank and fed to the engine with small power.

More particularly, this invention relates to a heating apparatus for heating liquid stored in a tank comprising a hollow member disposed substantially horizontally in the tank, and a heater housed in the hollow member and extending substantially over an entire length of the hollow member, the hollow member including inlet means to permit entry of the liquid into the hollow member and outlet means to permit exit of the liquid from the hollow member after the liquid is heated by the heater.

2. Description of the Prior Art

A known example of this type of heating apparatus is disclosed in Japanese Patent Publication No. 29-8136. To describe its construction roughly, a hollow member containing a heater is closed at one longitudinal end and open at the other to let in liquid. This hollow member is horizontally inserted into the tank, penetrating a side wall thereof, and includes an opening adjacent the other end thereof and outwardly of the tank to let out heated liquid.

Such a heating apparatus has the following disadvantages:

(a) The liquid flows in one direction within the hollow member from the inlet opening at one end to the outlet opening adjacent the other end, and gets gradually heated to a high temperature during the one-way flow. The liquid within the hollow member, therefore, has an increasingly less temperature gap with the heater toward the deep end or the other end of the hollow member. In other words, the heater produces a temperature characteristic curve rising sharply adjacent the inlet opening but levelling off with a worsening heat exchange rate toward the outlet opening. Thus it can be said that the prior art apparatus includes heat exchange regions having a poor temperature rising characteristic. That is to say the entire length of the heater is not utilized for effective heat exchanges. Therefore, in order to heat the outgoing liquid to a desired temperature it is necessary to increase the heater in length, number or power.

(b) The end of the hollow member where the liquid outlet opening is provided in the part that gets hottest. But since this part is located outwardly of a side wall of the tank, considerable energy loss occurs owing to heat radiation to the ambient.

(c) Since the hollow member communicates with the tank interior only through the inlet opening at one end thereof, the liquid within the hollow member may become overheated when there is no or only little liquid allowed to leave the hollow member through the outlet opening. This is because this known apparatus provides a low exchange rate between the hot liquid within the hollow member and cold liquid outside in the tank.

SUMMARY OF THE INVENTION

An object of this invention is to eliminate the above noted disadvantages of conventional heating apparatus, save the energy required for heating liquid, provide a heater of simple construction, and prevent the liquid within the hollow member from becoming overheated.

A heating apparatus for heating liquid in a tank according to this invention has a construction as set out in the Field of the invention hereinbefore, and is characterized in that the hollow member containing the heater has the inlet means comprising inlet openings defined at two respective longitudinal ends of the hollow member and the outlet means comprising an outlet opening defined at a longitudinally intermeidate position of the hollow member.

The above construction according to this invention has the following advantages:

(A) The liquid within the hollow member flows in two directions from the respective inlet openings at the two ends of the hollow member to the outlet opening at an intermediate position thereof. That is to say the passage length from each of the inlet openings to the outlet opening is half the length of the hollow member.

Thus each passage length of the flows in two different directions is half the length of the hollow member, and the liquid flows at a half speed compared with the case of the prior art provided that the passages of this invention and of the prior art construction have an equal sectional area. Although each passage length in this invention is half the passage length in the prior art, it is not that the liquid is half heated since it contacts the heater twice as long a time. The construction of this invention has a sufficient heating efficiency which is never lower than that of the prior art construction.

Moreover, that each passage length is half the length of the hollow member means that the liquid is heated by the heater only at regions where temperature rising characteristics are good and that the construction of this invention, unlike the prior art construction, does not include heat exchange regions having poor temperature rising characteristics. In other words, all the heat exchange regions in the construction of this invention have high temperature rising characteristics. By a synergistic effect of the above features the liquid is heated with great efficiency, which contributes toward energy saving and simplification of the heater.

(B) The hollow member having liquid inlet openings at the respective longitudinal ends thereof is immersed entirely in the liquid stored in the tank. This feature eliminates the disadvantage of the prior art construction which has one end of the hollow member disposed outside the tank, i.e. the disadvantage of heat radiation to the ambient from that end of the hollow member. This aspect of the invention also contributes toward energy saving.

(C) The hollow member is in communication at the two ends with the tank interior, and this feature is of advantage when there is no or only little liquid allowed to leave the hollow member through the outlet opening. Even if the liquid within the hollow member becomes heated rapidly, the hot liquid is promptly interchangeable by convection through the two openings of the hollow member with cold liquid in the tank. Therefore, the liquid will never become overheated inside the hollow member.

Other objects and advantages of this invention will be apparent from the following description.

BRIEF DESCRIPTION OF THE DRAWINGS

The drawings illustrate heating apparatus for heating liquid stored in a tank according to this invention, in which.

DETAILED DESCRIPTION OF THE PREFERRED EMBODIMENTS

Figure 1:
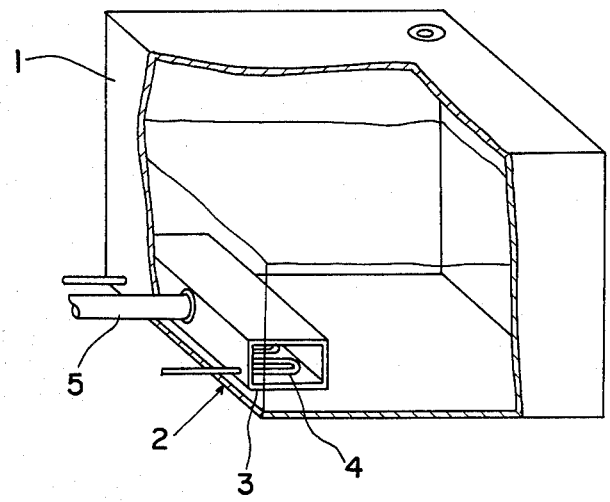
FIGS. 1 and 2 show a first embodiment of this invention, FIG. 1 being a partly broken away perspective view, and FIG. 2 being a cross section of a principal part.
Figure 2:
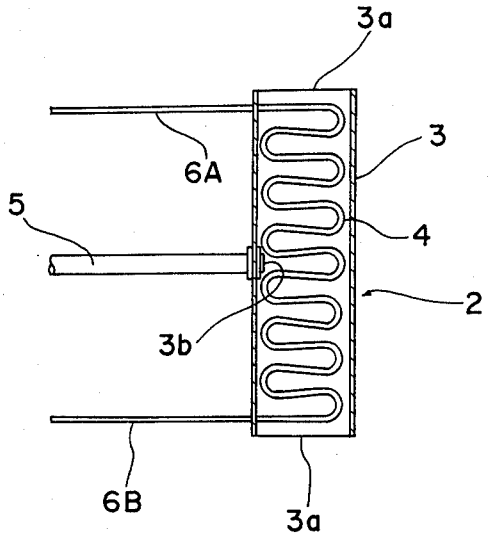

Referring to FIGS. 1 and 2 showing a first embodiment of this invention, a liquid storage tank 1 which is a fuel oil tank mounted in a bottom portion of a ship (not shown) contains a heating apparatus 2 according to this invention.

The heating apparatus 2 comprises a hollow member 3 formed of soft steel and installed horizontally in the tank 1. The hollow member 3 has inlet openings **3*a* at respective ends thereof to draw in fuel oil in the tank 1, and an outlet opening 3*b* at a longitudinally intermediate position thereof to which a pipe 5 is connected to take out heated oil. The hollow member 3 houses a heater 4 extending in a zigzag line substantially over an entire length of the hollow member 3. The heater 4 receives circulation of engine cooling water (70°-90° C.) which flows thereinto via a cooling water inlet pipe 6A and flows out via a cooling water outlet pipe 6B**.

Figure 3:
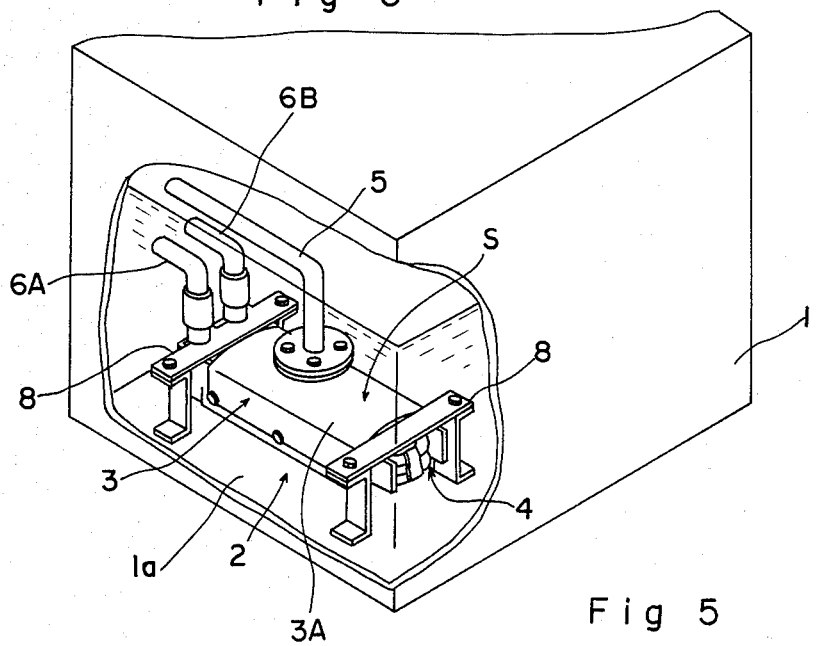
FIGS. 3 through 5 show a second embodiment, FIG. 3 being a partly broken away perspective view, FIG. 4 being a partly broken away plan view, and FIG. 5 being a view in vertical section.
Figure 5:
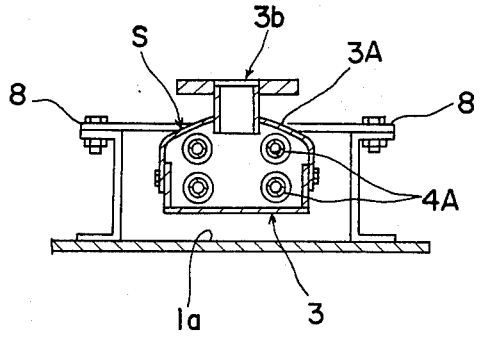
Figure 4:
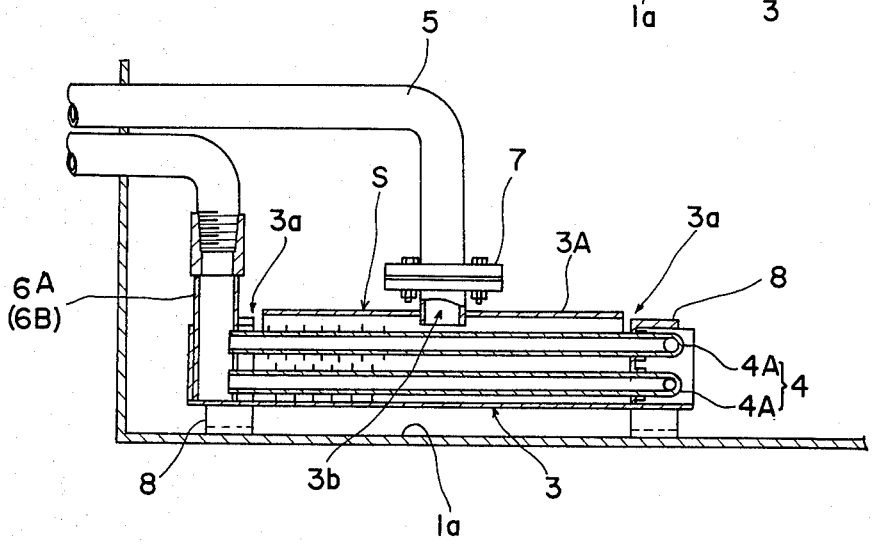

Referring to FIGS. 3 through 5 showing a second embodiment, a heating apparatus is installed in a tank 1 to be spaced upwardly from a bottom plate **1*a*** of the tank by several centimeters (which correspond to a dead oil thickness).

A hollow member 3 herein has an upwardly curved top plate 3A over an entire length thereof to provide an upwardly projecting portion S into which fuel oil heated by a heater 4 moves and concetrates by convection. An outlet opening **3*b* is defined at a longitudinally intermediate position of the hollow member 3 and at top of the upwardly projecting portion S to draw out the heated fuel oil. Reference number 3*a* denotes oil inlet openings defined at the respective ends of the hollow member 3**.

The heater 4 comprises two finned, U-shaped aluminum pipes 4A aranged one over the other and extending through the entire length of the hollow member 3. The heater 4 receives circulation of engine cooling water (70°-90° C.) via a cooling water inlet pipe 6A and a cooling water outlet pipe 6B.

Reference number 5 denotes a takeout pipe connected to the outlet opening **3*b* by a coupling 7** to transmit the heated fuel oil to an engine (not shown).

Reference number 8 denotes elements for fixing the heating appartus to the bottom plate **1*a* of the tank 1**.

Since in this embodiment fuel oil in the hollow member 3 is taken out from the upwardly projecting portion S, the oil introduced into the hollow member 3 is quickly heated to a desired temperature ready to be taken out, with a relatively small heating energy.

Figure 6:
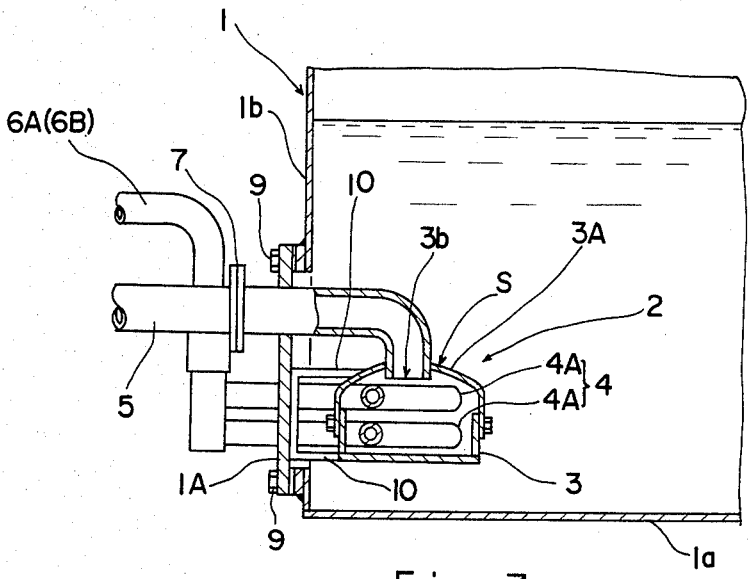
FIGS. 6 through 8 show a third embodiment, FIG. 6 being a partly broken away side view, FIG. 7 being a partly broken away plan view, and FIG. 8 being a partly broken away rear view.
Figure 7:
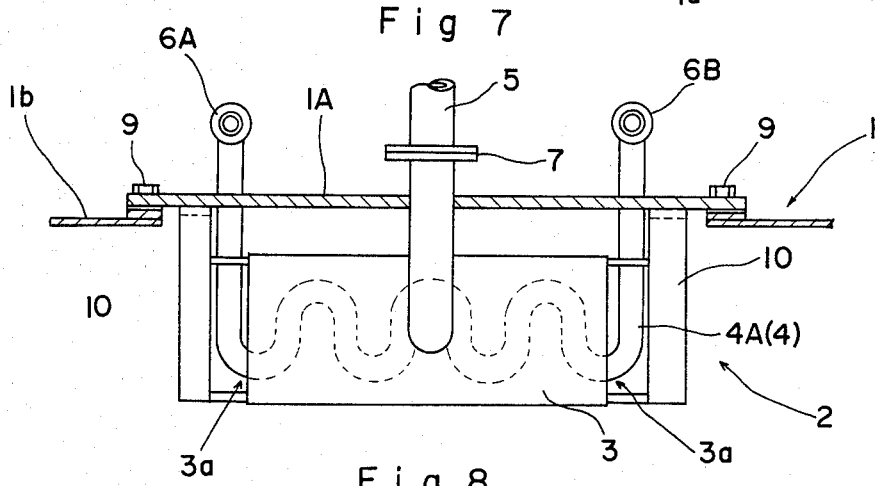
Figure 8:
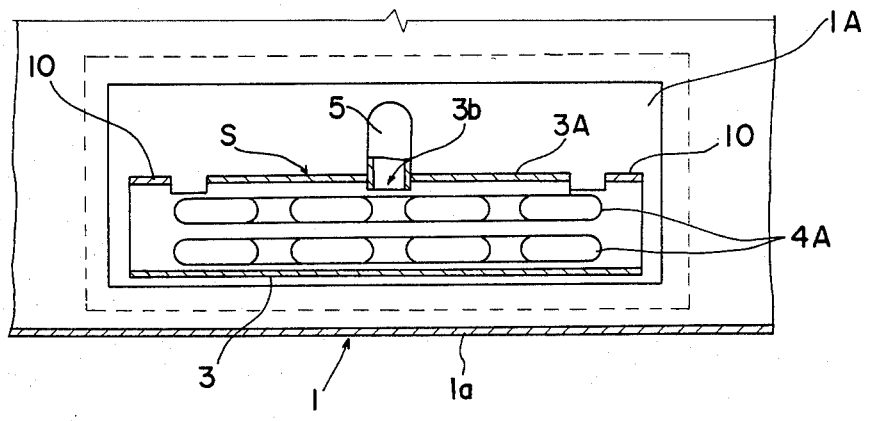

Referring to FIGS. 6 through 8 showing a third embodiment, a heating apparatus 2 comprises a hollow member 3 rigidly attached through support elements 10 to a lid member 1A which is removably attached by bolts 9 to a side wall **1*b* of a tank 1. A heater in this embodiment comprises two aluminum pipes 4A** arranged one over the other and each extending in a zigzag line.

This embodiment is substantially the same as the second embodiment in the other aspects. In particular, the hollow member 3 has a top plate 3A defining an upwardly projecting portion S, oil inlet openings **3*a* at the respective ends thereof, and an oil outlet opening 3*b* at an intermediate position. This embodiment also includes an oil takeout pipe 5, a coupling 7, and engine cooling oil inlet and outlet pipes 6A and 6B in communication with the aluminum pipes 4A**.

As seen, the heating apparatus 2 of this embodiment is secured not to a bottom plate **1*a* of the tank 1 but to an inner face of the lid member 1A removably attached to the side wall 1*b* of the tank 1. Therefore, workers need not enter the tank 1 in order to install the heating apparatus 2 in the tank 1 or to carry out maintenance work on the heating apparatus 2, and these operations can readily be done from outside the tank 1. This advantage is applicable also when the heating apparatus 2 is installed in an existing, used tank. The heating apparatus 2 may only be fixed to the lid member 1A** which is to be provided on a side wall of the tank.

Figure 9:
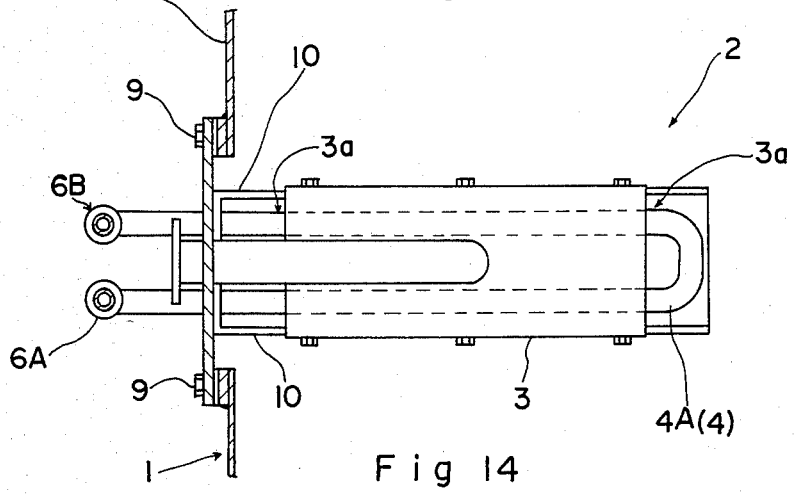
FIG. 9 is a partly broken away plan view showing a fourth embodiment.

Referring to FIG. 9 showing a fourth embodiment, the construction here is characterized by attachment of an elongate hollow member 3 to a lid membr 1A to be perpendicular to an inner face thereof. This embodiment has an advantage over the third embodiment in that the lid member 1A may be small.

A U-shaped aluminum pipe 4A is used in this embodiment. The other aspects of this embodiment are substantially the same as in the third embodiment, and therefore the components are not described again but are just shown with like reference numbers as in FIG. 7.

Referring to FIGS. 10 through 13 showing a fifth embodiment, a heating apparatus 2 comprises a hollow member 3 defining an oil outlet opening **3*b* at a longitudinally intermediate position thereof. An oil takeout pipe 5 connected to the outlet opening 3*b* communicates with a box 11 which houses an auxiliary heater 12. A further oil takeout pipe 13 is connected to the box 11 to take out oil heated by the auxiliary heater 12**.

The heater 4 in the heating apparatus 2 comprises two alluminum pipes 4A arranged one over the other and each extending in a zigzag line. The auxiliary heater 12 also comprises two aluminum pipes 12A arranged one over the other and each extending in a zigzag line. The heater 4 and the auxiliary heater 12 are in communication with each other.

This embodiment includes a tank 1, oil inlet openings 3*a* at the respective ends of the hollow member 3, an upwardly curved top plate 3A of the hollow member 3, inlet pipes 14A to introduce engine cooling water into the aluminum pipes 4A, and outlet pipes 14B to withdraw the engine cooling water from the aluminum pipes 12A.

Figure 14:
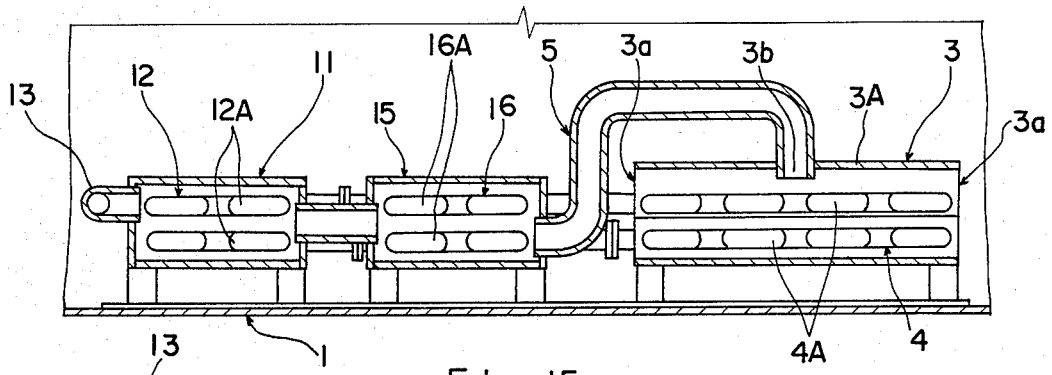
Figure 15:
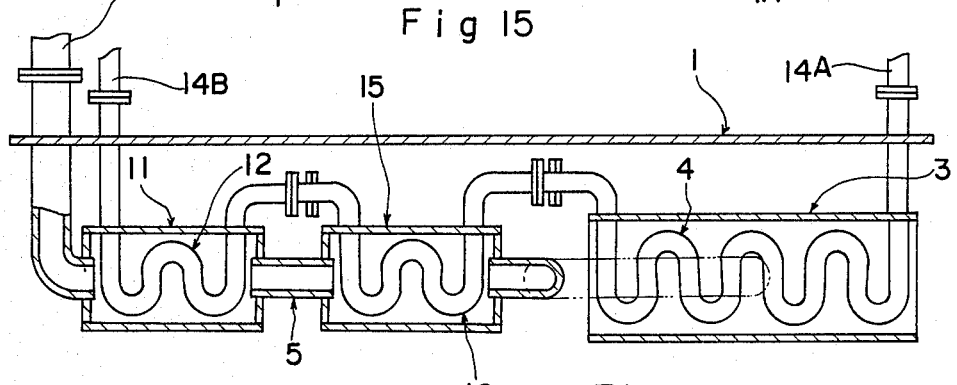

Referring to FIGS. 14 and 15 showing a sixth embodiment, the construction shown is modified from the fifth embodiment by providing a second box 15 containing an auxiliary heater 16 at an intermediate position of the oil takeout pipe 5 extending from the hollow member 3 to the box 11. The auxiliary heater 16 comprises aluminum pipes 16A in communication with the aluminum pipes 4A in the hollow member 3 and with the aluminum pipes 12A in the box 11 at the end, respectively. A plurality of second boxes 15 may be provided instead of one.

Figure 16:
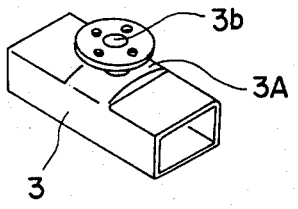
FIG. 16 is a perspective view showing a principal portion of a seventh embodiment.
Figure 17:
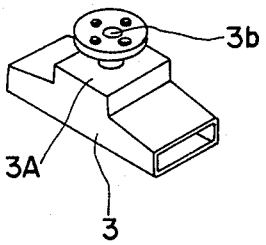
FIG. 17 is a perspective view showing a principal portion of an eighth embodiment.
Figure 10:
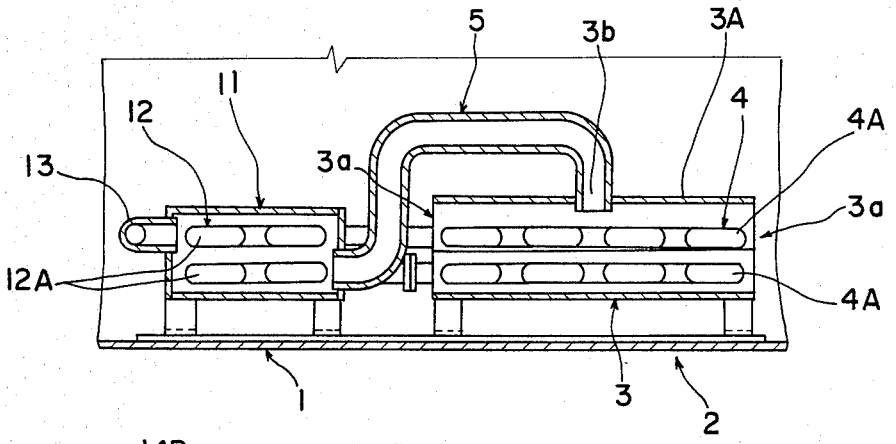
FIGS. 10 through 13 show a fifth embodiment, FIG. 10 being a partly broken away front view, FIG. 11 being a partly broken away plan view, FIG. 12 being a sectional view taken on line XII—XII of FIG. 11, and FIG. 13 being a sectional view taken on line XIII—XIII of FIG. 12, FIGS. 14 and 15 show a sixth embodiment, FIG. 14 being a partly broken away front view, and FIG. 15 being a partly broken away plan view.
Figure 11:
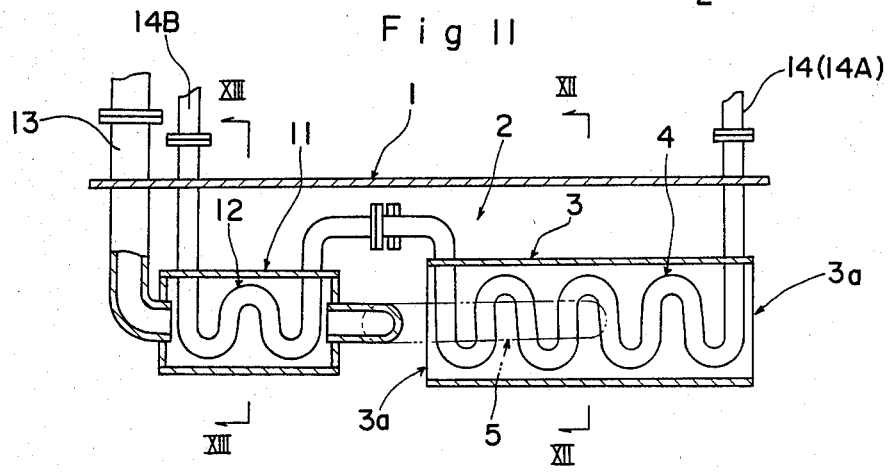
Figure 12:
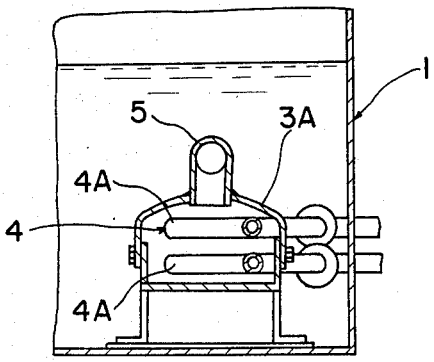
Figure 13:
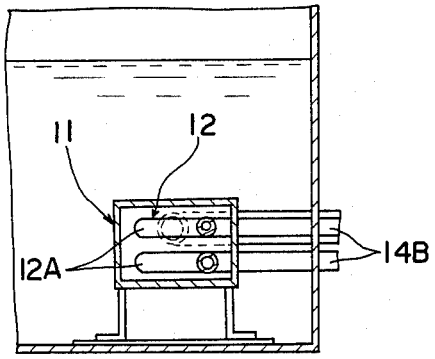

In each of the first to sixth embodiments described above, the top plate 3A of the hollow member 3 may be modified, as shown in FIGS. 16 and 17, to project upwardly only at a longitudinally intermediate position where the oil outlet opening 3*b* is defined.

The hollow member 3 should preferably have an insulating structure comprising, for example, an insulating material such as rubber or polystyrene foam attached to surfaces of the hollow member 3, or the hollow member 3 per se formed of an insulating material.

The heater 4 may receive circulation of hot gas, or may be electrically operated. The heater 4 should preferably comprise a finned pipe or pipes in case hot liquid (or engine cooling water) or hot gas is circulated therein.

We claim:

1. A heating apparatus for heating liquid in a tank comprising:

a hollow member disposed substantially horizontally in said tank near the bottom thereof; and a heater housed in said hollow member and extending substantially along the entire length of said hollow member, said hollow member including an inlet opening at the respective longitudinal ends of said hollow member so that said liquid enters said hollow member through each of said inlets, said hollow member further including an outlet opening at the longitudinal middle of said hollow member for discharging liquid heated by said heat.

2. An apparatus as defined in claim 1 wherein the outlet opening is defined at the highest position of a top plate of the hollow member, the top plate projecting upwardly at least at the middle of said hollow member.

3. An apparatus as defined in claim 2 wherein the hollow member has an insulating structure and is rigidly attached to a lid member removably mounted to a side wall of the tank.

4. An apparatus as defined in claim 3 wherein the outlet opening is connected to a box member having an auxiliary heater therein.

5. A heating apparatus as defined in claim 1 wherein said liquid storage tank is a fuel oil storage tank for an engine and said heater includes means for circulating engine cooling fluid therethrough.

* * * * *